US006776071B1

(12) United States Patent
Chen

(10) Patent No.: US 6,776,071 B1
(45) Date of Patent: Aug. 17, 2004

(54) STEPLESS RATCHET WRENCH STRUCTURE

(76) Inventor: Jui-Pin Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/383,726

(22) Filed: Mar. 10, 2003

(51) Int. Cl.[7] ..... B25B 13/46
(52) U.S. Cl. ..... 81/60; 81/58
(58) Field of Search ..... 81/60, 58, 58.3, 81/59.1

(56) References Cited

U.S. PATENT DOCUMENTS 2,824,476 A * 2/1958 Wilson ..... 81/58
3,444,767 A * 5/1969 Cupler ..... 81/63.1
5,115,699 A * 5/1992 Mertens ..... 81/59.1
5,351,583 A * 10/1994 Szymber et al. ..... 81/60
6,612,205 B1 * 9/2003 Jones ..... 81/63.1

* cited by examiner

*Primary Examiner*—Joseph J. Hail, III
*Assistant Examiner*—David B. Thomas
(74) *Attorney, Agent, or Firm*—Leong C. Lei

(57) ABSTRACT

A stepless ratchet wrench structure includes a wrench body having a through hole at the center thereof for holding individual components and the bottom of the body being an integrally formed stepless circular disc seat, wherein a frictional slanting face of the circular disc seat faces upward, a stepless rotating structure including a spherical circular disc, a c-shaped fastening ring being a slot for insertion into the wrench body, and a holding rod structure having a rotating block with a circular hole at the center thereof, and the external being connected to a spring and a holding rod, the front end of the holding rod being a cylindrical body for insertion into the circular hole of the disc.

1 Claim, 6 Drawing Sheets

STEPLESS RATCHET WRENCH STRUCTURE

BACKGROUND OF THE INVENTION (a) Technical Field of the Invention

The present invention relates to ratchet wrench, and in particular, to a stepless ratchet wrench.

(b) Description of the Prior Art

FIG. 1 is a perspective view of a conventional ratchet wrench having a wrench body being provided with a cavity containing ratchet gear, ratchet block, triggering plate and an elastic element, wherein when the ratchet wrench is triggered, the ratchet gear rotates along the circumferential edge to a position, the teeth of the ratchet block urges the teeth of the ratchet gear, and the wrench can be rotated tightly or loosen.

The shortcoming of the ratchet wrench is that there is insufficient torque, and fine adjustment is not possible as a result of the problem caused by the tolerance between the individual teeth. Therefore, it is troublesome when a specific specification of the ratchet wrench is used.

SUMMARY OF THE INVENTION

Accordingly, it is an object of the present invention to provide a stepless ratchet wrench structure, wherein the problem due to insufficient torque is overcome and a holding rod structure is provided to secure the above ratchet wrench structure.

Yet another object of the present invention is to provide a stepless ratchet wrench structure, wherein the problem caused by the tolerance between the individual teeth is solved.

A further object of the present invention is to provide a stepless ratchet wrench structure, wherein the holding rod can swing within a small space.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
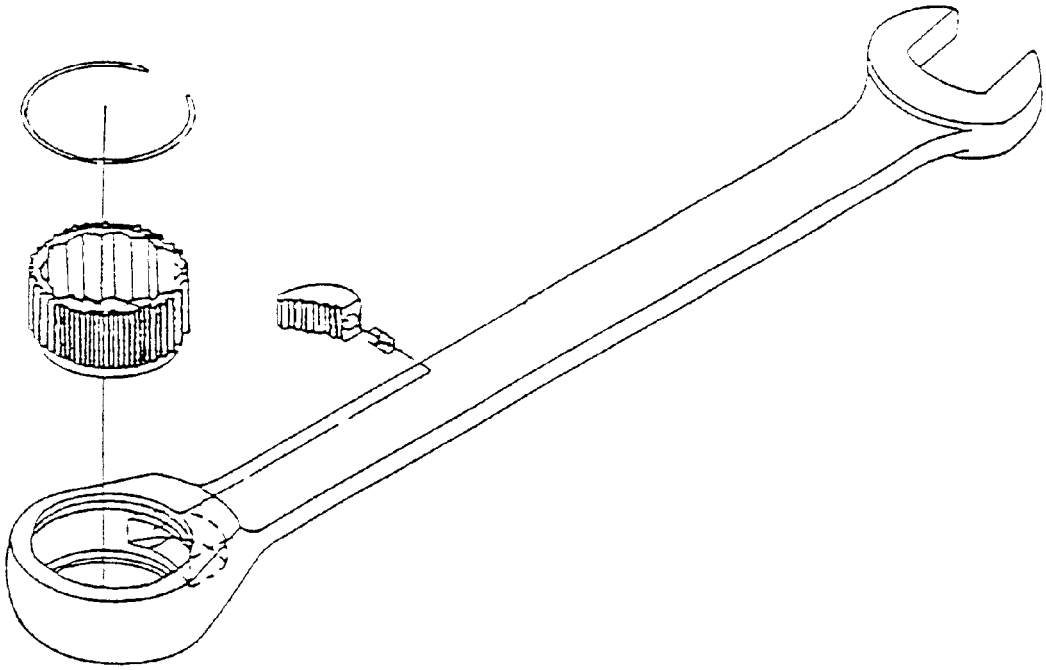
PRIOR ART FIG. 1
FIG. 1 is a perspective view of a conventional ratchet wrench.
Figure 2:
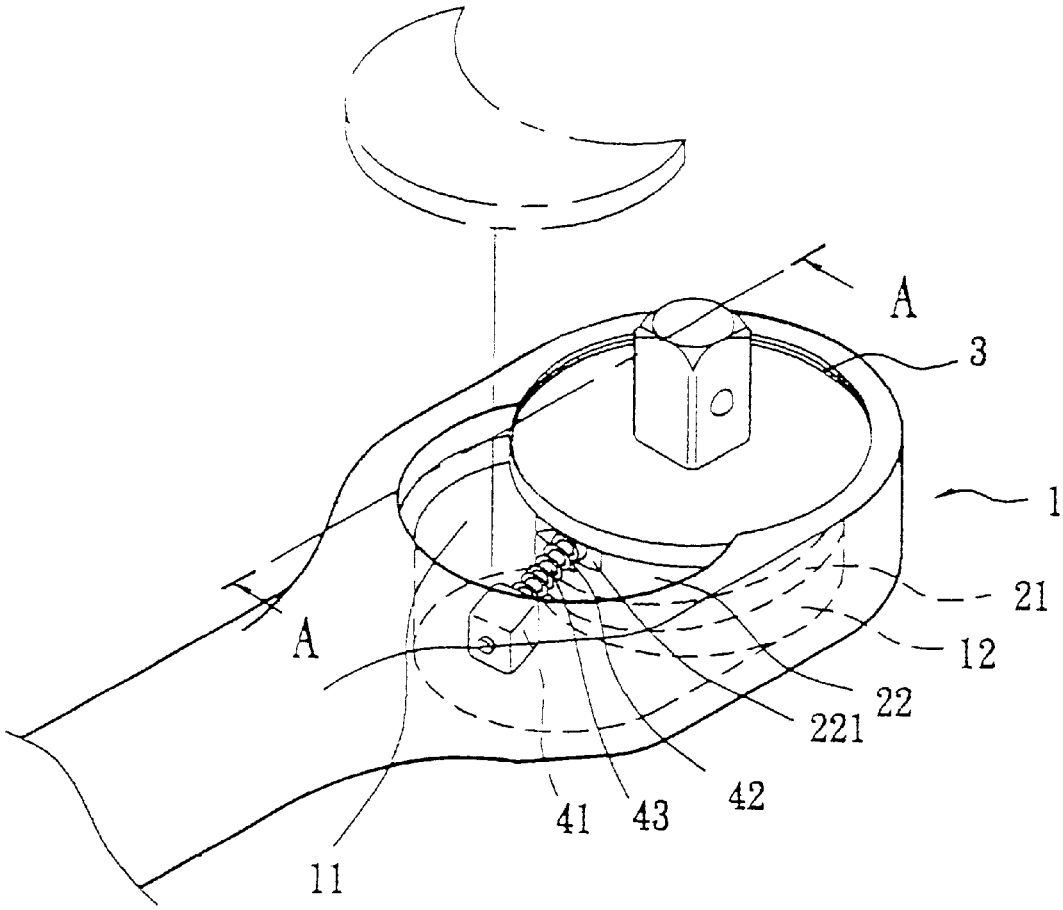
FIG. 2 is a perspective view of a ratchet wrench of the present invention.
Figure 3:
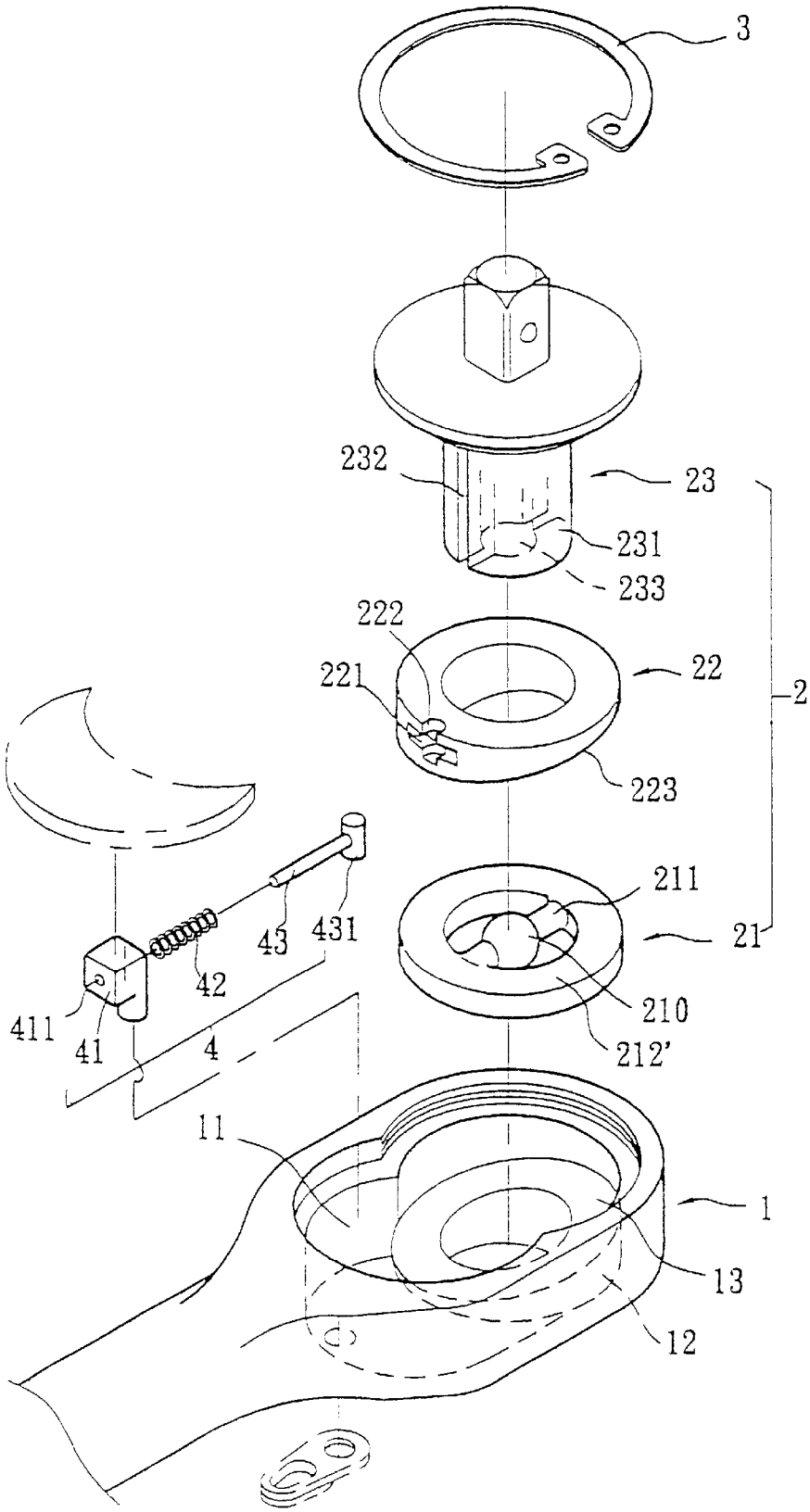
FIG. 3 is a sectional view along line A—A of FIG. 1 of the present invention.

Referring to FIGS. 2, and 3, there is shown a stepless ratchet wrench structure comprising a wrench body 1 having a through hole 11 at the center thereof for holding individual components and the bottom of the body 1 being an integrally formed stepless circular disc seat 12, wherein a frictional slanting face of the circular disc seat 12 faces upward; a stepless rotating structure 2 including a spherical circular disc 21, wherein the center of the circular disc 21 is provided with a circular spherical ball 210, and the spherical ball 210 is extended out with an arm 211 connected to the wall face of the inner diameter of the circular disc 21 and the top and bottom plan 212, 212' of the circular disc 21 are provided with rotating friction for the top and bottom component, the top end of the circular disc 21 is corresponding to a slanting stepless face, and the circular disc 21 and the bottom 223 of the disc 21 has an angle and provides rotational friction for the top end plan of the circular disc 21, the external diameter of the circular disc 21 is provided with a slot 221 and a circular hole 222 from top to bottom, which is formed into a "cross", the top end of the circular disc 21 is corresponding to a connecting shaft 23 having a top end mounted with a connector, and the bottom end of the connecting shaft 23 is extended to a shaft center 231 of an appropriate length, the radial of the shaft center is provided with a slot 233 of an appropriate depth, and the circular slot 233 with an appropriate depth is provided at the center of the slot so as to provide connection for the stepless circular disc 22 and the spherical circular disc 21, and the spherical body 210 is inserted into the circular hole 233.

Figure 4:
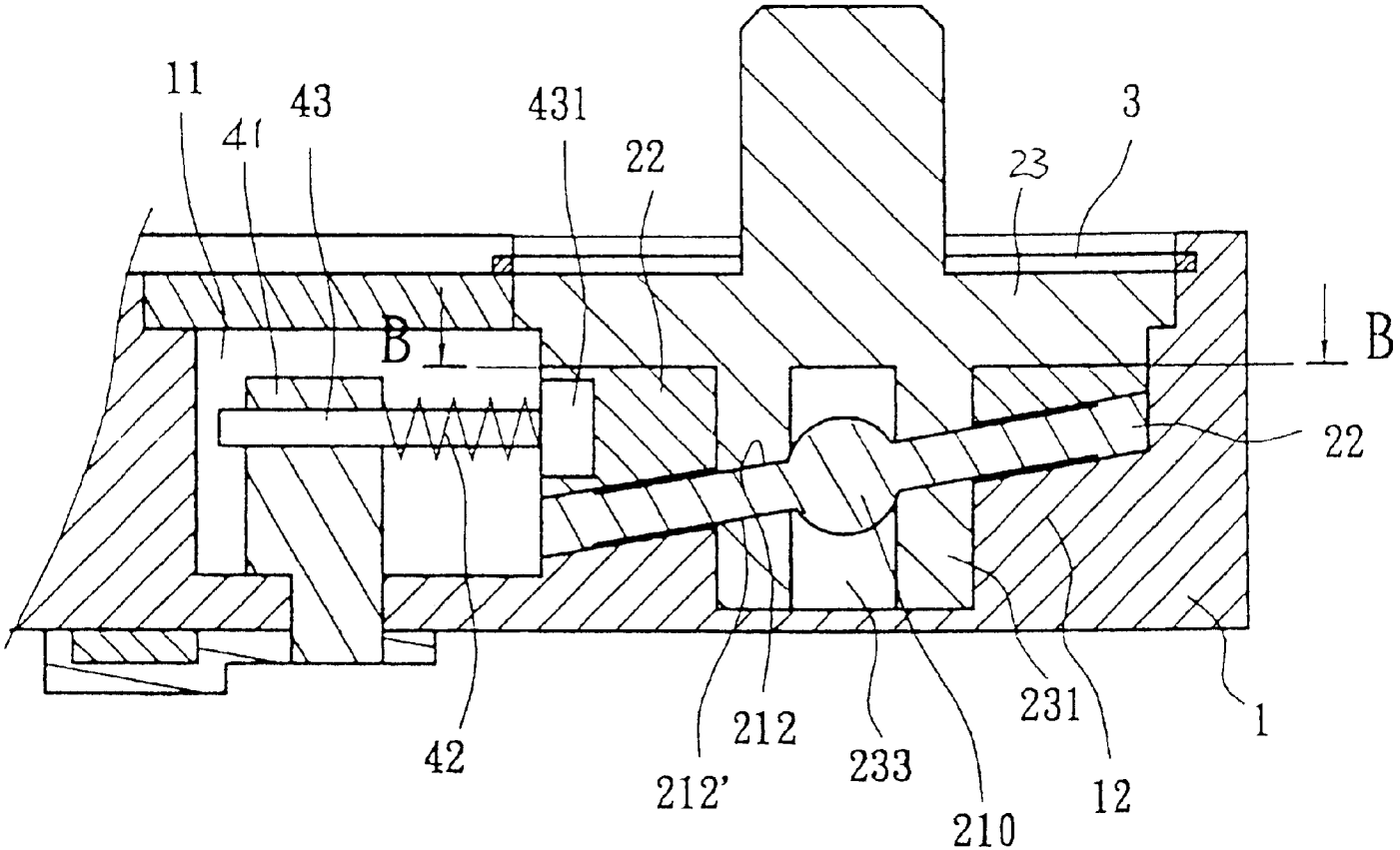
FIG. 4 is a sectional view along line B—B of the present invention.

A c-shaped fastening ring 3 is a slot for insertion into the wrench body 1 to provide limiting function for the stepless rotating structure 2, and a holding rod structure 4 is a rotating block 41 with a circular hole 411 at the center thereof, and the external thereof is connected to a spring 42 and a holding rod 43, the front end of the holding rod 43 is a cylindrical body 431 for insertion into the circular hole 222 of the disc 22, as shown in FIG. 4.

Figure 5:
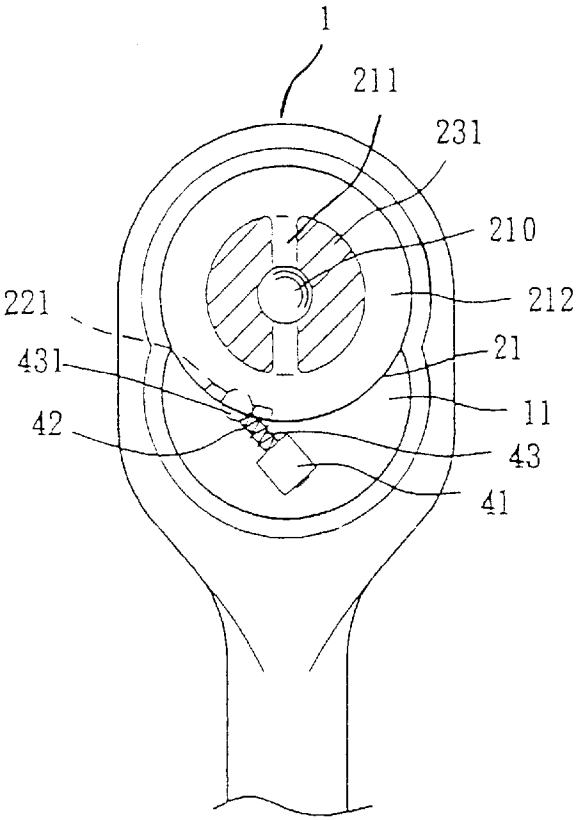
FIG. 5 is a schematic view with the present invention.

As shown in FIG. 5, the connection shaft 23 is inserted into a spherical circular disc 21 and a slanting stepless circular disc 22 which is connected to the slanting stepless circular disc 12. The sphere 210 of the spherical circular disc 21 is mounted to the shaft center 231 of the connection shaft 23. When in rotation, the slanting stepless circular disc 22 at the top end thereof is driven by the sphere 210 and the arm 211, and the top plan 212 of the spherical circular disc 21 and the bottom portion 223 of the slanting stepless circular disc 21, and the bottom plan 212 and the frictional slanting face 13 of the circular disc seat 12 are frictionally rotating when the holding structure 4 is stationary, the rod 43 and the spring element 42 are extended to the circular hole 222 of the slanting stepless circular disc 22 so that the rotating structure 2 is stationary.

Figure 6:
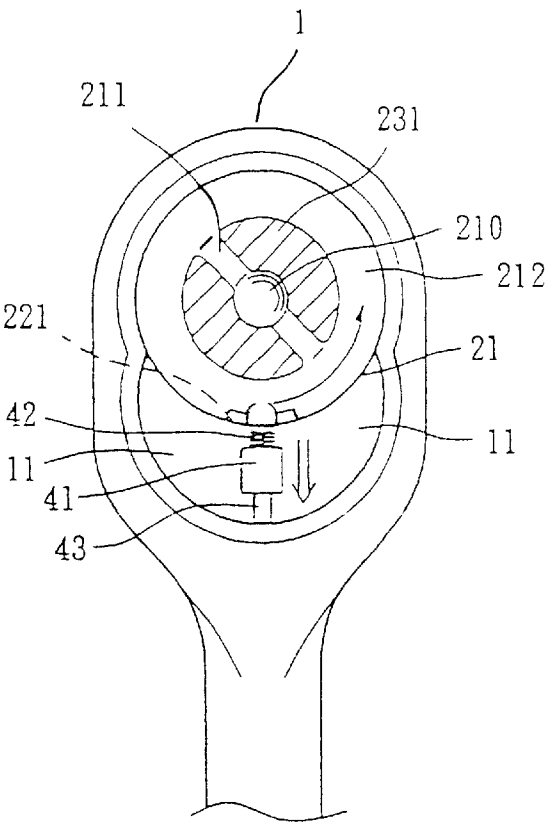
FIG. 6 is a schematic view along line B—B of the present invention.
Figure 7:
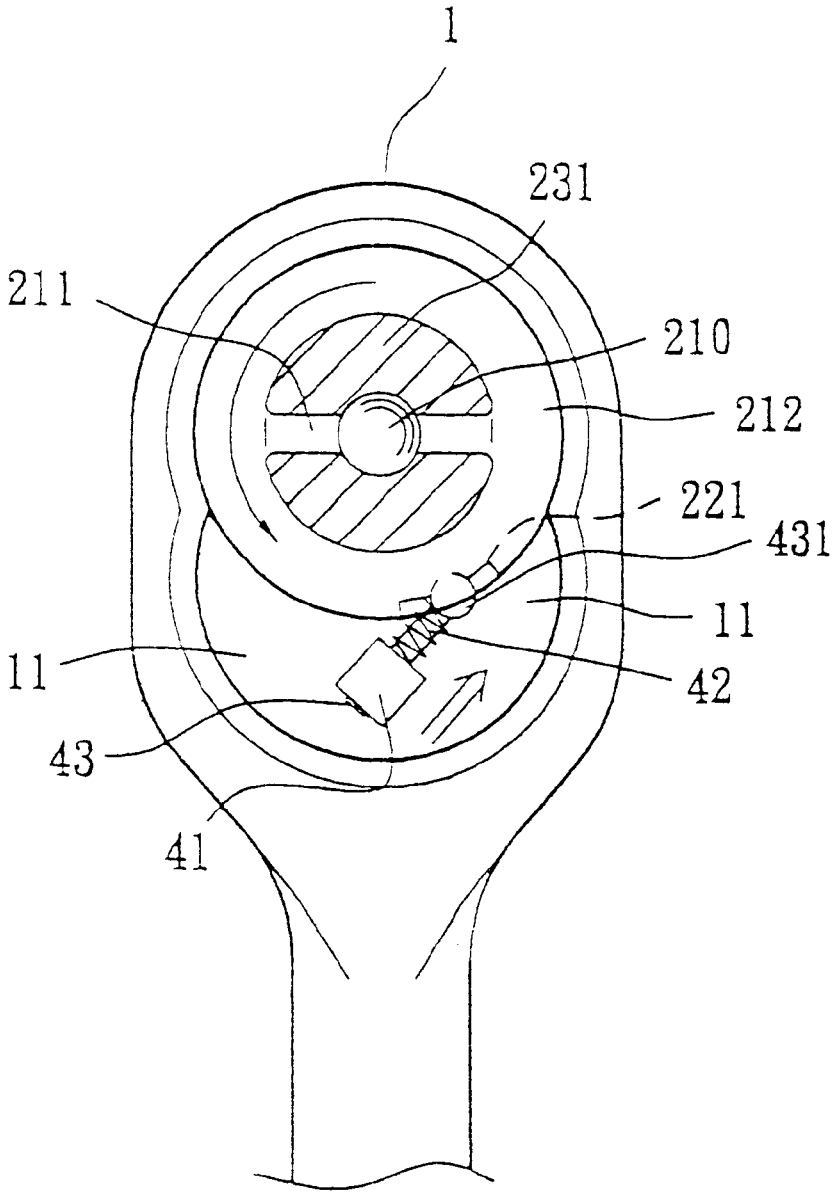
FIG. 7 is another schematic view along line B—B of the present invention.

As shown in FIG. 6, when the connection shaft 23 rotates to an angle the contact faces of the spherical disc 21, the slanting stepless circular disc 22 and the slating stepless circular disc seat 12 are rotated frictionally. The holding rod 43 and the elastic element 42 are moved backward as a result of pressing by the slanting stepless circular disc 22. Next, when the holding rod is at an angle, the holding rod 43 is pushed externally by the external force of the elastic element 42, and the slanting stepless circular disc 22 moves forward to secure (as shown in FIG. 7).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A stepless ratchet wrench structure comprising:

(a) a wrench body having a through hole at the center thereof for holding individual components and the bottom of the body being an integrally formed stepless circular disc seat, wherein a frictional slanting face of the circular disc seat faces upward;

(b) a stepless rotating structure including a spherical circular disc, wherein the center of the circular disc is provided with a circular spherical ball, and the spherical ball is extended out with an arm connected to the wall face of the inner diameter of the circular disc and the top and bottom plan of the circular disc are provided with rotating friction for the top and bottom component, the top end of the circular disc is corresponding to a slanting stepless face, circular disc and the bottom of the disc has an angle and provides rotational friction for the top end plan of the circular disc, the external diameter of the circular disc is provided with a slot and a circular hole from top to bottom, which is formed into a "cross", the top end of the circular disc is corresponding to a connecting shaft having a top end mounted with a connector, and the bottom end of the connecting shaft is extended to a shaft center of an appropriate length, the radial of the shaft center is provided with a slot of an appropriate depth, and a circular hole with an appropriate depth is provided at the center of the slot so as to provide connection for the stepless circular disc and the spherical circular disc, and the spherical body is inserted into the circular hole;

(c) a c-shaped fastening ring being a slot for insertion into the wrench body; and (d) a holding rod structure having a rotating block with a circular hole at the center thereof, and the external being connected to a spring and a holding rod, the front end of the holding rod being a cylindrical body for insertion into the circular hole of the disc.

* * * * *